US006713693B1

(12) United States Patent
Sadowski et al.

(10) Patent No.: US 6,713,693 B1
(45) Date of Patent: Mar. 30, 2004

(54) ELECTRIC SWITCH HAVING BOTH TOGGLE AND ROCKER FUNCTIONS

(75) Inventors: Walter Sadowski, Stonington, CT (US); Rick Olson, North Newington, CT (US); Shakib Saria, Glastonbury, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 10/354,889

(22) Filed: Jan. 30, 2003

(51) Int. Cl.[7] ..... H01H 21/54
(52) U.S. Cl. ..... 200/18; 200/17 R; 200/5 R
(58) Field of Search ..... 200/4, 5 R, 16 R, 200/17 R, 18, 339

(56) References Cited

U.S. PATENT DOCUMENTS 5,451,729 A * 9/1995 Onderka et al. ..... 200/18
5,508,479 A * 4/1996 Schooley ..... 200/5 R
5,952,628 A * 9/1999 Sato et al. ..... 200/4
5,952,631 A * 9/1999 Miyaki ..... 200/6 A
6,246,019 B1 * 6/2001 Nakamura et al. ..... 200/6 A

* cited by examiner

*Primary Examiner*—Richard K. Lee
(74) *Attorney, Agent, or Firm*—McCormick, Paulding & Huber LLP

(57) ABSTRACT

A switch having independently operable toggle and rocker functions. The switch having a housing, a toggle member pivotally mounted in the housing, the toggle member having upper and lower portions. The upper portion being movable for providing a toggle function of the switch, the lower portion being attached to the upper portion and having at least one first contact element coupled thereto. The switch having a rocker member coupled to the housing for providing a rocker function, the rocker member defining a central opening for receiving the upper portion of the toggle member, and having a second contact element coupled thereto. The switch including a circuit board inside the housing having a first conductive portion adjacent the first contact element, and a second conductive portion adjacent the second contact element. The toggle and rocker members being independently operable for providing toggle and rocker functions of the switch respectively.

23 Claims, 6 Drawing Sheets

FIG. 9
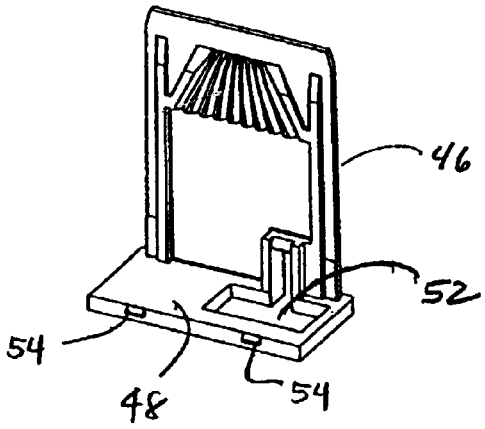
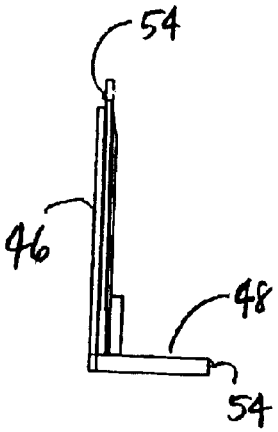
FIG. 10
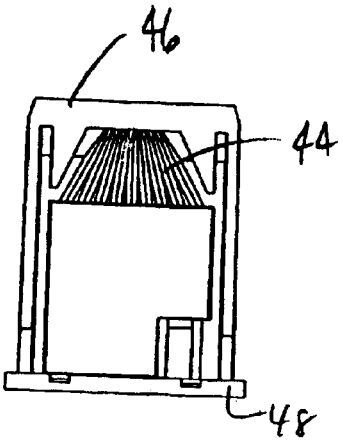
FIG. 11
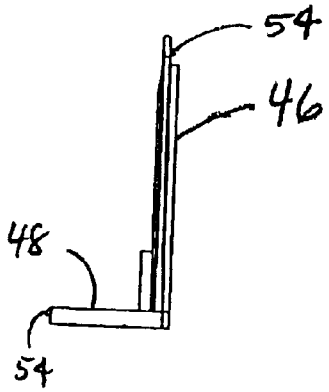
FIG. 12

30
32
56
J3
CON1
J5
CON1
R8 1.5K
R7 47K
OUTPUT
C3 .1uf
R16 220K
R5 180
R14 20K
C4 22uf
R4 10K
R6 5.6K
R3 1.5K
R9 2.2K
R10 2.2K
R11 2.2K
R12 2.2K
R13 2.2K
T6
T5
T4
T3
T2
T1
GND
COM
HS
LS
BAT
OUTPUT
LED
WW
J1
8 HEADER
COM
LS
HS
D3
LED
D4
LED
R15 470
R17 TBD
LED
D2
R18 0
R1 1.2K
R2 1.2K
D2
D1
C2 .01uf
D1
C1 .1uf
CON1
J4
CON1
WW
DC
BAT

ELECTRIC SWITCH HAVING BOTH TOGGLE AND ROCKER FUNCTIONS

FIELD OF THE INVENTION

The present invention relates generally to electric switches and in particular to an electric switch providing independently operable toggle and rocker functions.

SUMMARY OF THE INVENTION

The present invention provides an electric switch having both toggle and rocker functions that are independently operable. The switch includes a toggle member pivotally coupled to a housing, the toggle member having an upper portion positionable for operating a toggle function of the switch and a lower portion having a first contact element coupled thereto. A rocker member is also coupled to the housing for operating a rocker function of the switch. The switch housing is preferably formed from a dielectric thermoplastic material such as nylon, however other materials could be utilized as well. The rocker member defines a central opening and has a second contact element coupled thereto. The upper portion of the toggle member extends through the opening in the rocker member. A circuit board is attached interior the housing and disposed parallel to the plane of pivotal motion of the toggle member. The circuit board has a first conductive portion disposed adjacent the first contact element so that the first contact element is connectable with the first conductive portion in various configurations providing the toggle function of the switch. A second conductive portion is disposed on the circuit board adjacent the second contact element for providing the rocker function of the switch.

In a preferred embodiment, the switch includes a flexible portion covering the central opening defined by the rocker member and sealed about the upper portion of the toggle member. The flexible portion can provide a seal to protect the switch from contaminants or the environment. Preferably, the flexible portion is manufactured from an elastomeric material such as rubber. Additionally, the switch can include LEDs or other devices to illuminate various portions of the switch. In one embodiment the rocker member 16 is translucent and includes an LED such that the rocker member itself is illuminated.

BRIEF DESCRIPTION OF THE DRAWINGS

FIG. 9 is a perspective view of the bottom and side panels of the housing of the FIG. 1 switch;

FIG. 10 is a left side elevational view of the housing panels shown in FIG. 9;

FIG. 11 is a front side elevational view of the housing panels shown in FIG. 9;

FIG. 12 is a right side elevational view of the housing panels shown in FIG. 9.

DETAILED DESCRIPTION

Figure 1:
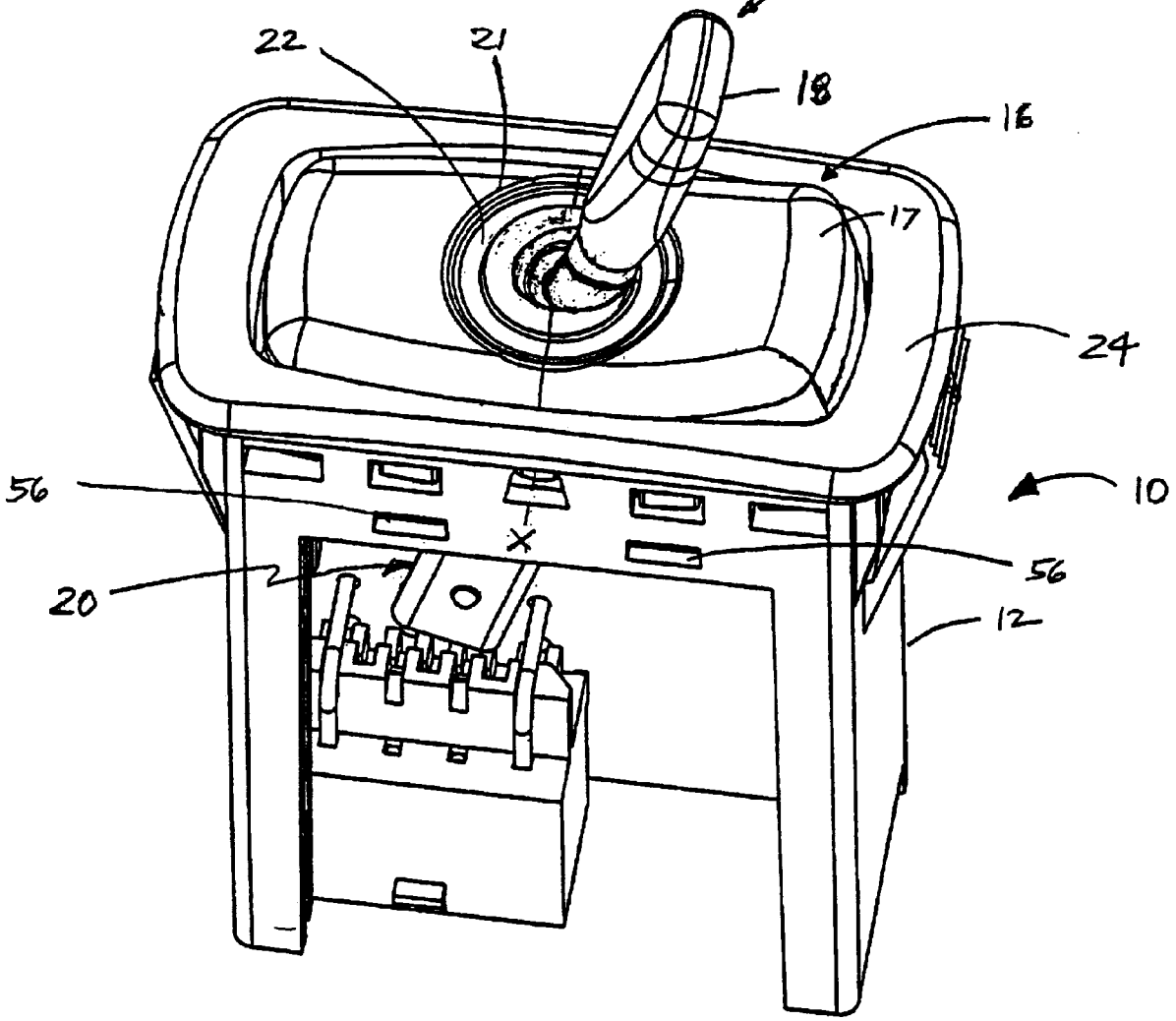
FIG. 1 is a perspective view of the preferred embodiment of the present invention switch shown without the bottom and side panels.

Referring to the drawings, FIG. 1 shows the present invention switch, referred to generally by the reference numeral 10. The switch 10 has a housing 12, a toggle member generally referred to by the reference numeral 14, and a rocker member generally 16. The toggle member 14 is pivotally coupled to the housing 12 about an axis X, such that an upper portion 18 of the toggle member extends on one side of the X axis generally exterior of the housing 12 for manual control of the toggle function of the switch 10. A lower portion, generally 20, of the toggle member 14 is attached to the upper portion 18 and extends interior the housing 12 on an opposing side of the axis X. The switch 10 has a housing 12 that has removable side and bottom panels, FIGS. 1 and 2 show the housing 12 without these panels.

The rocker member 16 is also coupled to the housing for motion relative thereto for manual operation of a rocker function of the switch 10. The rocker member 16 defines a central opening 21 through which the upper portion 18 of the toggle member 14 extends and is operable. The rocker member 16 has a flexible portion 22 that covers the central opening 21 and is sealed about the upper portion 18 of the toggle member 14 to protect the switch 10 from the environment. Preferably, the flexible portion 22 is manufactured from an elastomeric material such as rubber. A bezel 24 surrounds both the toggle member 14 and the rocker member 16 of the switch 10. In the preferred embodiment, an actuator portion 17 of the rocker member 16 is manufactured from a resiliently deformable elastormeric material and the flexible portion 22 is formed integral therewith.

Figure 2:
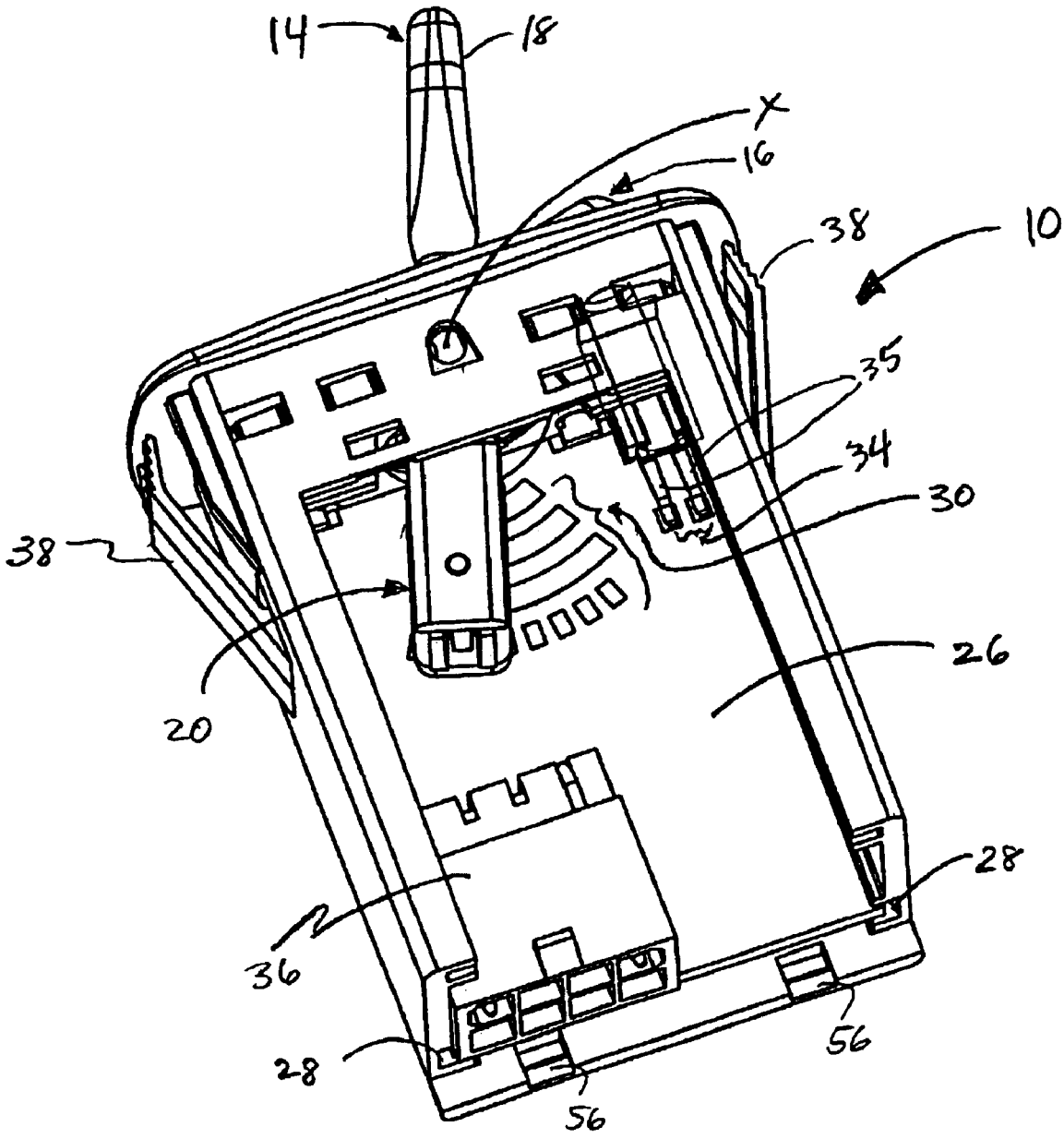
FIG. 2 is a perspective view of the switch shown in FIG. 1.

Referring to FIG. 2, the switch 10 includes a circuit board 26 coupled to the housing 12 parallel to the plane of pivotal motion of the toggle member 14. In the embodiment shown, the circuit board 26 is slideably engaged in the slots 28 provided in the housing 12. The circuit board 26 has a first conductive portion 30 that is disposed adjacent the lower portion 20 of the toggle member 14 for selective electrical connection with first contact elements 32 (shown in FIG. 4). The contact elements 32 are carried by a lever 33 attached to the lower portion 20 of the toggle member 14 and spring biased via a spring 45 to ensure an electrical connection between the contact elements 32 and the first conductive portion 30. In the embodiment shown, the contact elements 32 are dumbbell-shaped and arranged to provide an electrical connection between one or more portions of the first conductive portion 30 on the circuit board 26 depending on the selected position of the upper portion 18 of the toggle member 14.

Still referring to FIG. 2, the circuit board 26 has a second conductive portion 34 disposed adjacent a second contact element 35 that cooperate to provide, in part, the rocker function of the switch 10. A connector 36 is coupled to the circuit board 26 and connects the first and second conductive portions of the circuit board, 30 and 34 respectively, to a wiring harness (not shown). A pair of flexible wing members 38 are attached to the housing 12 for mounting the switch 10 in a control panel (not shown) of a vehicle or other apparatus.

Figure 4:
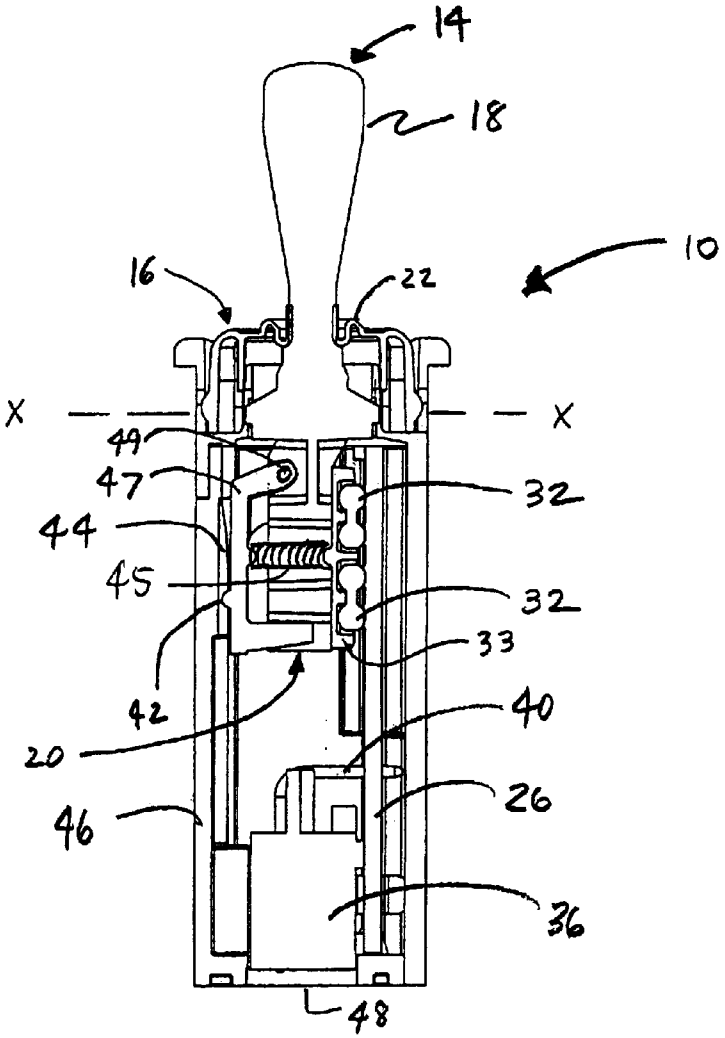
FIG. 4 is a cut-away view of the switch of FIG. 3.
Figure 3:
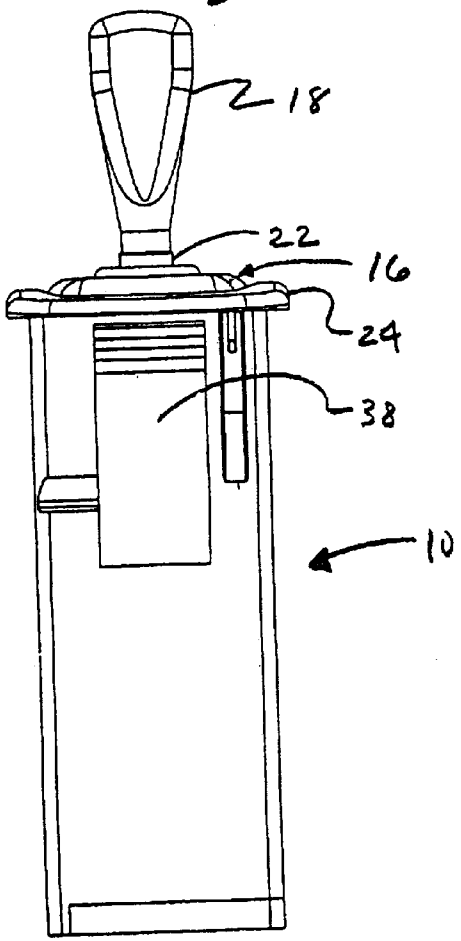
FIG. 3 is an elevational view of an end of the FIG. 1 switch.

Referring to FIGS. 3 and 4, the switch 10 is shown in elevational end views wherein FIG. 4 is a cut-away view of the switch of FIG. 3 that shows the interior area of the switch defined by the housing 12. FIGS. 3 and 4 show the switch 10 with the side panel 46 and the bottom panel 48 of the housing 12 attached thereto. Referring to FIG. 4, the lower portion 20 of the toggle member 14 is shown having the dumbbell-shaped contact elements 32 disposed in the lever 33 and adjacent the circuit board 26. The connector 36 is coupled to the circuit board 26 via a plurality of pins 40. A shoulder or detent 42 is attached to a hinged member 47 of the lower portion 20 of the toggle member 14. The hinged member 47 is pivotable about a hinge pin 49 and cooperates with an incremental detent 44 on the side panel 46 of the housing 12 to secure the selected position of the toggle member 14 of the switch 10. A spring 45 operates between the hinged member 47 and the lever 33 and biases the detent 42 against the incremental detent 44 and provides a force for electrically connecting the first contact elements 32 with the first conductive portion 30 of the circuit board 26. Alternatively, the hinged member 47 and lever 33 could include one or more plastic hinges eliminating the need for the spring 45.

Figure 5:
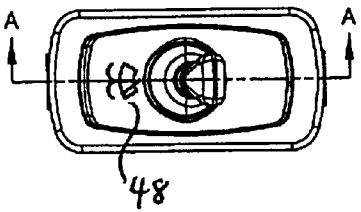
FIG. 5 is a top plan of the FIG. 1 switch.

Referring to FIG. 5, the preferred embodiment of the switch 10 is shown having indicia 48 on the rocker member 16 indicating the function of the switch. The switch 10, shown in FIG. 5 is configured for use in a vehicle wherein the windshield wipers are operated using the toggle function of the switch and a windshield washer pump is controlled using the rocker function of the switch, however, the switch 10 can be used to control many other devices or functions thereof.

Figure 8:
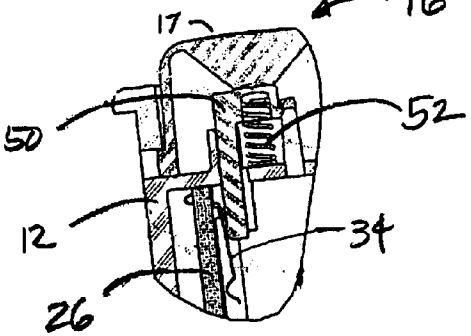
FIG. 8 is a detailed view of the area D identified in FIG. 7.
Figure 7:
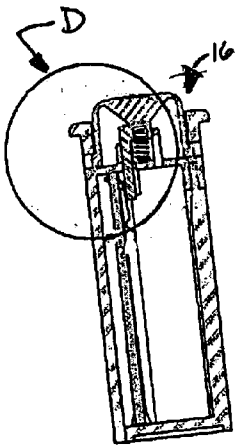
FIG. 7 is a sectional view of the FIG. 1 switch taken generally at the line C—C identified in FIG. 6.
Figure 6:
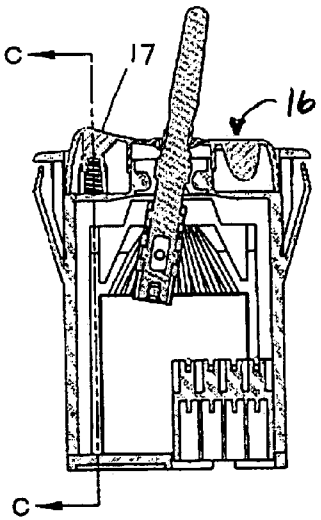
FIG. 6 is sectional view of the FIG. 1 switch taken generally at the line A—A identified in FIG. 5.

FIGS. 6–8 show details of the rocker function of the switch 10. The actuator portion 17 of the rocker member 16 is positioned adjacent to plunger 50. A compression spring 52 biases the plunger against the rocker member 16. In the preferred embodiment, the rocker switch is a momentary contact switch, wherein the second contact element 35 makes contact with the second conductive portion 34 of the circuit board 26 only when the actuator portion 17 is depressed. In other embodiments of the present invention, the rocker member 16 of the switch 10 includes an acuator portion 17 at either end thereof. Accordingly, the rocker member 16 could be configured to function as an on/off switch wherein depressing one end of the rocker member 16 closes the switch and depressing an opposing end of the rocker member 16 opens the switch. Alternatively, the rocker function of the switch 10 can be configured to function as an on/off switch wherein repeatedly depressing one end of the rocker member 16 functions to both open and close the switch. However, the present invention is not limited in this regard as both the toggle and rocker functions of the switch 10 can be configured in numerous known methods, depending on the application, and not depart from the scope and spirit of the invention.

Referring to FIGS. 9–12, the removable side panel 46 and bottom panel 48 of the housing 12 are shown in various views thereof. The bottom panel 48 defines an opening 52 aligned with the connector 36 so that a cooperating connector on a wiring harness (not shown) can be coupled to the connector 36.

Tabs 54 are disposed on the removable panels 46 and 48 to couple the panels to the housing 12 via cooperating openings 56 therein.

Figure 13:
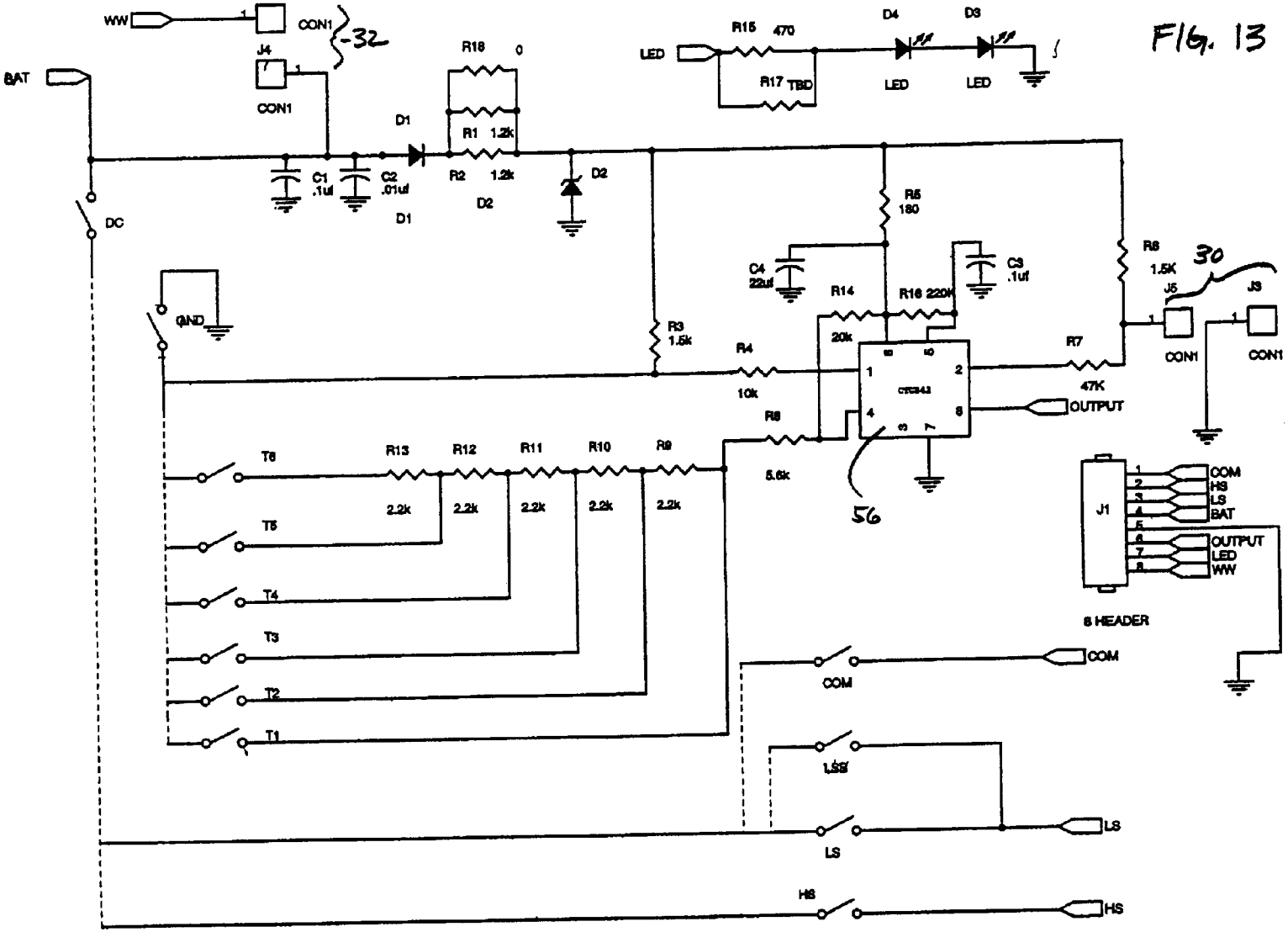
FIG. 13 is a schematic of the circuit board of one embodiment of the present invention.

FIG. 13 is a schematic of the circuit board 26 of an embodiment of the switch 10 configured to control windshield wipers using the toggle function of the switch and a windshield washer pump using the rocker function of the switch. The circuit board 26 includes an electronic device 56 for providing standard outputs common for controlling windshield wipers including outputs required for intermittent and delay features and the like.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A switch having independently operable toggle and rocker functions comprising:

a housing, a toggle member pivotally mounted in said housing, said toggle member having upper and lower portions, said upper portion being manually movable to provide a toggle function of said switch, said lower portion attached to said upper portion and having at least one first contact element coupled thereto, a rocker member coupled to said housing for motion relative thereto and providing a rocker function of said switch, said rocker member defining a central opening for receiving said upper portion of said toggle member, and having a second contact element coupled thereto, a circuit board positioned inside said housing and oriented parallel to the plane of pivotal motion of said lower portion of said toggle member, said circuit board having a first conductive portion disposed adjacent the first contact element for cooperation therewith, and a second conductive portion disposed adjacent the second contact element for cooperation therewith, a connector coupled to said circuit board for electrically connecting said first and second conductive portions of said circuit board to a wiring harness, said toggle member and said rocker member of said switch being independently operable for selectively connecting said first and second contact elements with said first and second conductive portions respectively.

2. A switch as defined in claim 1 wherein said rocker member further comprises a flexible portion covering said opening therein and sealed about said upper portion of said toggle member.

3. A switch as defined in claim 2 wherein said flexible portion of said rocker member is elastomeric.

4. A switch as defined in claim 1 wherein said rocker member seals the housing from the environment.

5. A switch as defined in claim 1 wherein said housing has a bezel surrounding both said toggle member and said rocker member of said switch.

6. A switch as defined in claim 1 wherein said housing further comprises at least one flexible wing member for mounting said switch in a panel.

7. A switch as defined in claim 1 wherein said connector includes a connective portion accessible externally of said housing.

8. A switch as defined in claim 1 wherein said housing has a portion that includes detents defining at least two stable positions for said toggle member, said lower portion of said toggle member having a shoulder for engaging said detent defining housing portion.

9. A switch as defined in claim 1 wherein said circuit board further comprises an electronic device.

10. A switch as defined in claim 1 wherein said first contact element includes at least one dumbbell shaped contact element.

11. A switch as defined in claim 1 wherein said toggle function is adapted to control a windshield wiper circuit and said rocker function is adapted to control a windshield washer circuit in a vehicle.

12. A switch as defined in claim 1 wherein said switch further comprises an illumination source.

13. A switch as defined in claim 1 wherein said housing is further defined by a bottom wall, said bottom wall defining an opening for said connector, said connector having a connective portion accessible externally said housing.

14. A switch as defined in claim 1 wherein said toggle function includes a plurality of switch conditions for various configurations of said connection between said each of a plurality of said first contact elements and said first conductive portion of said circuit board.

15. A switch having both toggle and rocker functions comprising:

a housing, a toggle member pivotally mounted in said housing, said toggle member having upper and lower portions thereof, said upper portion positionable for operating a toggle function of said switch, said lower portion attached to said upper portion and having a first contact element coupled thereto, an elastomeric rocker member coupled to said housing for operating a rocker function of said switch, said rocker member defining a central opening therein, and having a second contact element coupled thereto, said upper portion of said toggle member extending through said central opening said rocker member sealing said upper portion of said toggle member in said opening, a circuit board positioned inside said housing and oriented parallel to the pivotal motion of said toggle member, said circuit board having a first conductive portion disposed adjacent the first contact element for cooperation therewith and a second conductive portion disposed adjacent the second contact element for cooperation therewith, a connector coupled to said circuit board for electrically connecting said first and second conductive portions of said circuit board to a wiring harness, said toggle member and said rocker member of said switch being independently operable for selectively connecting said first and second contact elements with said first and second conductive portions respectively.

16. A switch as defined in claim 15 wherein said housing has a bezel surrounding both said toggle member and said rocker member.

17. A switch as defined in claim 15 wherein said housing further comprises at least one flexible wing member for mounting said switch in a panel.

18. A switch as defined in claim 15 wherein said connector has a connective portion connectable to a corresponding connector on a vehicle's wiring harness.

19. A switch as defined in claim 15 wherein said lower portion of said toggle member further comprises a spring biased hinged member having a detent for cooperating with a portion of said housing defining at least two stable positions of said toggle member for securing a selected position of said toggle member.

20. A switch as defined in claim 19 wherein said spring provides a force for electrically connecting said first contact element with said first conductive portion of said circuit board.

21. A switch as defined in claim 15 wherein said first contact element includes at least one dumbbell shaped contact element.

22. A switch as defined in claim 15 wherein a portion of said rocker member seals the housing of said switch.

23. A switch as defined in claim 15 wherein said rocker member further comprises a resiliently deformable actuator for opening said rocker function of said switch.

* * * * *

UNITED STATES PATENT AND TRADEMARK OFFICE

CERTIFICATE OF CORRECTION

PATENT NO. : 6,713,693 B1
DATED : March 30, 2004
INVENTOR(S) : Sadowski et al.

It is certified that error appears in the above-identified patent and that said Letters Patent is hereby corrected as shown below:

Title page,
Item [75], Inventors, address information for "Rick Olson", please delete "North"; and address information for "Walter Sadowski", please delete "Stonington" and insert -- Newington --.

Signed and Sealed this

Second Day of November, 2004

JON W. DUDAS
*Director of the United States Patent and Trademark Office*